US008900037B2

(12) United States Patent
Jöst

(10) Patent No.: US 8,900,037 B2
(45) Date of Patent: Dec. 2, 2014

(54) GRINDING DEVICE FOR MACHINE BASED GRINDING OF ROTOR BLADES FOR WIND ENERGY SYSTEMS

(75) Inventor: Peter Jöst, Abtsteinach (DE)

(73) Assignee: JÖST GmbH, Wald-Michelbach (DE)

( * ) Notice: Subject to any disclaimer, the term of this patent is extended or adjusted under 35 U.S.C. 154(b) by 217 days.

(21) Appl. No.: 13/582,041

(22) PCT Filed: Aug. 25, 2011

(86) PCT No.: PCT/EP2011/064645

§ 371 (c)(1),
(2), (4) Date: Aug. 30, 2012

(87) PCT Pub. No.: WO2012/025598

PCT Pub. Date: Mar. 1, 2012

(65) Prior Publication Data

US 2012/0318190 A1 Dec. 20, 2012

(30) Foreign Application Priority Data

Aug. 27, 2010 (EP) ..... 10174283

(51) Int. Cl.

| | |
|---|---|
| ***B24B 37/34*** | (2012.01) |
| ***B24B 21/16*** | (2006.01) |
| ***B24B 55/08*** | (2006.01) |

(52) U.S. Cl.

CPC ..... *B24B 21/16* (2013.01); *B24B 55/08* (2013.01)

USPC ..... 451/67; 451/168; 451/303; 451/311; 451/73; 15/97.1

(58) Field of Classification Search

CPC .... B24B 37/345; B24B 37/04; B24B 41/005; B24B 57/02; H01L 21/67219

USPC ..... 451/67, 168, 303, 311, 59, 453, 456, 451/296, 302, 66, 73, 304, 305; 15/97.1, 15/102; 118/75

See application file for complete search history.

(56) References Cited

U.S. PATENT DOCUMENTS

| | | | | | |
|---|---|---|---|---|---|
| 859,966 | A | * | 7/1907 | Mowry | 118/69 |
| 1,225,982 | A | * | 5/1917 | Lupinski et al. | 118/66 |
| 1,511,059 | A | * | 10/1924 | Maranville | 427/430.1 |
| 2,594,647 | A | * | 4/1952 | Hendrickson | 451/303 |
| 2,714,787 | A | * | 8/1955 | Orr | 451/304 |
| 2,791,514 | A | * | 5/1957 | Mears | 430/564 |
| 3,085,268 | A | * | 4/1963 | Proulx | 15/21.1 |
| 3,237,230 | A | * | 3/1966 | Forrest | 15/100 |
| 3,518,796 | A | * | 7/1970 | Gawronski | 451/184 |
| 3,812,622 | A | * | 5/1974 | Parsons | 451/72 |
| 3,850,691 | A | * | 11/1974 | Bleil et al. | 134/4 |
| 3,984,212 | A | * | 10/1976 | DeMusis | 451/302 |

(Continued)

FOREIGN PATENT DOCUMENTS

| | | |
|---|---|---|
| DE | 102005002886 | 5/2006 |
| WO | 2006006843 | 1/2006 |

*Primary Examiner* — George Nguyen

(74) *Attorney, Agent, or Firm* — Hartman Titus PLC; John D. Titus

(57) ABSTRACT

The present invention relates a grinding device 1 for the machine-based grinding of rotor blades 100 for wind energy systems, comprising a belt grinding unit 10 with a circulating grinding belt 12.

17 Claims, 5 Drawing Sheets

(56) References Cited

U.S. PATENT DOCUMENTS

Figure 1:
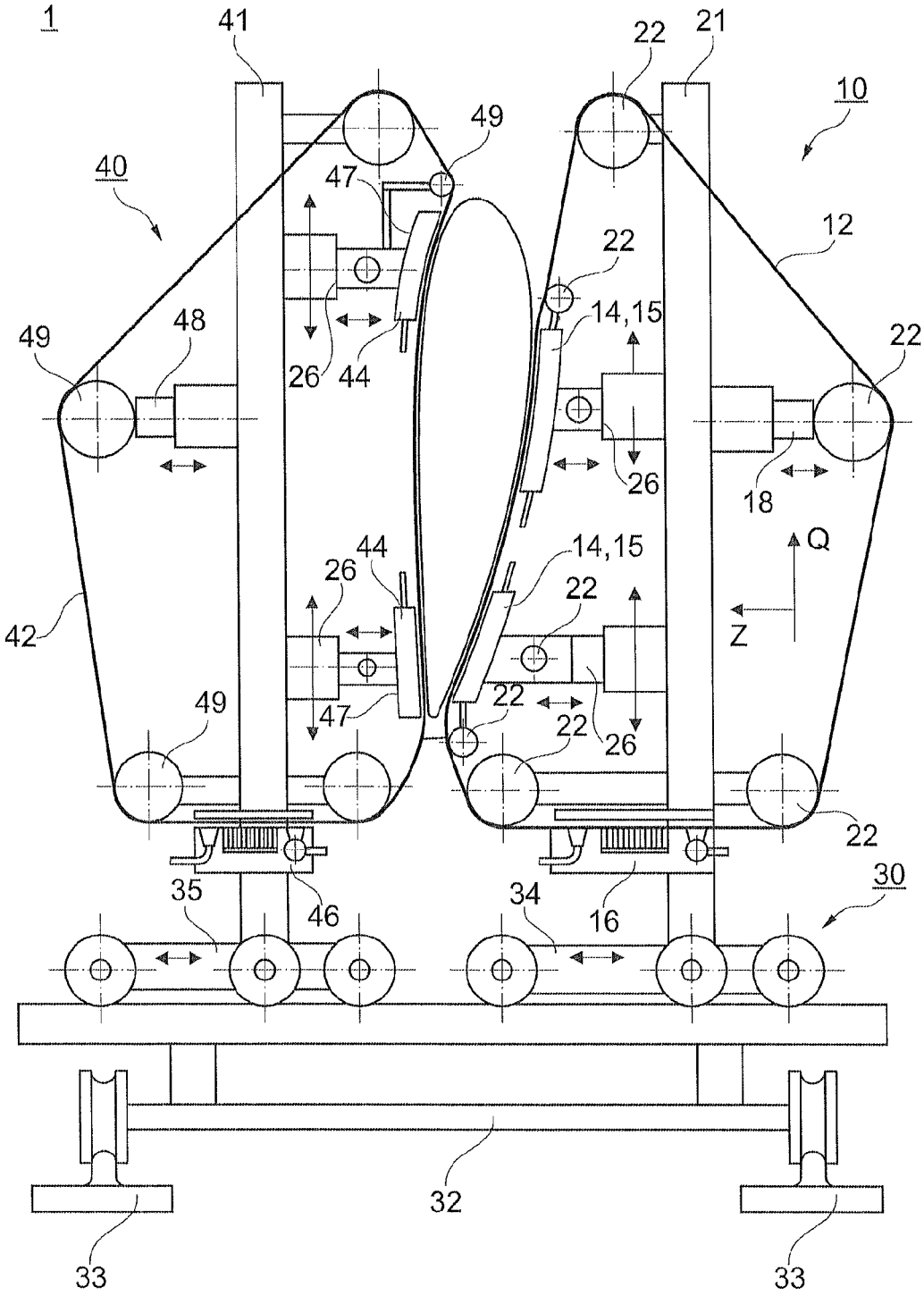

| | | | | |
|---|---|---|---|---|
| 4,021,969 | A * | 5/1977 | Davis, Jr. | 451/311 |
| 4,031,669 | A * | 6/1977 | Koide et al. | 451/304 |
| 4,145,846 | A * | 3/1979 | Howland et al. | 451/5 |
| 4,501,095 | A * | 2/1985 | Drinkuth et al. | 451/5 |
| 4,525,955 | A * | 7/1985 | Cothrell et al. | 451/296 |
| 4,662,116 | A * | 5/1987 | Erani | 451/65 |
| 4,676,029 | A * | 6/1987 | Palmer | 451/5 |
| 4,768,311 | A * | 9/1988 | Olson | 451/59 |
| 4,815,238 | A * | 3/1989 | Simpson et al. | 451/296 |
| 6,220,946 | B1 * | 4/2001 | Arnold | 451/307 |
| 6,439,961 | B1 * | 8/2002 | Hammond et al. | 451/5 |
| 6,869,334 | B1 * | 3/2005 | Leyendecker et al. | 451/38 |
| 7,032,279 | B2 * | 4/2006 | McCarvill et al. | 29/90.01 |
| 7,601,226 | B2 * | 10/2009 | Voges et al. | 134/6 |
| 8,366,515 | B2 * | 2/2013 | Joslin | 451/59 |
| 8,567,058 | B2 * | 10/2013 | Moller et al. | 29/889.1 |
| 2002/0072297 | A1 * | 6/2002 | Kennerknecht et al. | 451/5 |
| 2005/0042102 | A1 | 2/2005 | Teichert | |
| 2009/0169734 | A1 | 7/2009 | Teichert | |
| 2009/0258579 | A1 * | 10/2009 | Joslin | 451/59 |
| 2010/0071209 | A1 | 3/2010 | Moller | |
| 2012/0322349 | A1 * | 12/2012 | Josi | 451/73 |

* cited by examiner

GRINDING DEVICE FOR MACHINE BASED GRINDING OF ROTOR BLADES FOR WIND ENERGY SYSTEMS

1. FIELD OF THE INVENTION

The present invention relates to a grinding device for machine-based grinding of rotor blades for wind energy systems. By the use of the grinding device, grinding tasks can be automated during the manufacturing and during the maintenance of rotor blades.

2. PRIOR ART

The use of wind force for the energy generation is seen as one of the most environmentally compatible forms of generating energy. Therefore, wind energy systems are used that comprise a rotor that drives a generator and that is supported rotatably at a mast. The loads that affect the parts, in particular the rotor blades of a wind energy system, are, however, very high.

Atmospheric influences like, for instance, wind, water, hail, UV-radiation, erosion- and bending-loads make the highest demands on the material of the rotor blades. The correct operation and the surface quality are relevant for the effectiveness and economic efficiency of wind energy systems. Thus, rotor blades comprise a specific coating, wherein the application thereof is very time-consuming, since, as a rule, every single layer of the coating has to be ground.

The extremely loaded polymer surfaces of rotor blades are coated with a plurality of layers. The layer systems for the protection of the surfaces consist of a so-called gel coat, filler compound, edge protection and cover lacquers. The products that are used therefore consist essentially of solvent-free, two-component polyurethane compounds. After the application of the single layers, each one has to be ground.

These grinding tasks are very human-resource-intensive processes, since they are carried out manually using hand grinding machines. The rotor blades to be ground comprise, for instance, a length of up to about 80 m and a surface to be ground of up to about 300 $m^2$. Accordingly, the surface that has to be manually ground is very large.

A further reason for the fact that grinding tasks at rotor blades are still carried out manually by means of hand grinding machines, for instance by means of eccentric grinders with dust suction devices, lies in the fact that the coatings of the rotor blades to be ground are designed very viscoplastic, and thus the grinding discs clog very fast. With one grinding disc only a little surface can be ground, and then this grinding disc has to be exchanged by a new grinding disc. This can be done very fast by hand for hand grinding machines. Due to the high changing rates, up to now also grinding robots could not be used economically. With a grinding disc—although it comprises a suction device—only about 0.5 $m^2$-1.5 $m^2$ of the viscoplastic coating of a rotor blade can be ground. But the surface of a wind energy wing with a wing length of about 60 m to about 80 m is 160 $m^2$ to 300 $m^2$, so that per rotor blade and grinding iteration about 300-600 grinding discs have to be used. As a rule, there are 3-4 grinding iterations per rotor blade.

The viscoplastic coatings of the rotor blades are used, because rotor blades move with speeds of up to 300 km/h and they are not allowed to be damaged, when for instance hailstones dash against them. In the documents DE 298 05 833 U1, DE 199 29 386 A and DE 297 09 342 U1, coating systems for rotor blades are described.

The enormous dimensions of rotor blades and the problems that arise during the grinding of the viscoplastic coating did not allow an automation of the grinding tasks up to now. The costs for the grinding tasks may be 30% and more of the manufacturing costs of a rotor blade.

Thus, it is the problem of the present invention to solve the above-mentioned deficits and to optimize the grinding process for rotor blades of wind energy systems and to design it more cost-effective.

3. SUMMARY OF THE INVENTION

The above-mentioned problem is solved by a grinding device for machine-based grinding of rotor blades for wind energy systems according to patent claim 1.

In particular, the above-mentioned problem is solved by a grinding device for the machine-based grinding of rotor blades for wind energy systems, comprising a belt grinding unit with a circulating grinding belt.

By the use of a grinding device for machine-based grinding of rotor blades the grinding process can be automated, so that no manual grinding is necessary anymore. Grinding tasks that currently are carried out by means of hand grinding machines can be omitted and be carried out by means of the grinding device according to the invention. This is rendered possible by the use of a belt grinding unit with a circulating grinding belt that allows grinding also several 100 $m^2$of viscoplastic coating of a rotor blade for wind energy systems in a machine-based manner.

The use of circulating grinding belts has the advantage that always only a part of the grinding belt is in engagement with the rotor blade, while another part of the grinding belt is freely accessible and can be cleaned from the viscoplastic grinding dust in this area. This prevents a fast clogging of the grinding belt with the viscoplastic grinding dust.

Furthermore, the effectively usable surface of a grinding belt is significantly larger than with grinding discs for hand-guided grinding machines. So, the grinding surface of the grinding belt can be designed according to the size of the surface of a rotor blade, so that an exchange of the grinding belt is not necessary before the grinding of at least one side of a rotor blade or the entire rotor blade. Furthermore, a grinding belt has the advantage that the grinding speed can be controlled continuously and be exactly adapted to the coating of the rotor blades. There is always the problem for rotating or oscillating grinding discs that, as a matter of principle, lower speeds are present in the inner area of the grinding disc than in the outer areas, which leads to a worse grinding result and to a faster clogging of the used grinding discs.

Preferably, the grinding device further comprises a drive unit for the movement of the belt grinding unit in the direction of the longitudinal axis of a rotor blade. The belt grinding unit is moved with the grinding belt that is preferably transversely circulating the rotor blade by a drive unit in the direction of the longitudinal axis of the rotor blade. Thus, it is possible to grind in one grinding iteration one side of the rotor blade continuously. The continuous grinding process also results in a more homogeneous grinding result than by discontinuous grinding by hand. By the rotation of the rotor blade around its longitudinal axis in further iterations, the entire surface of the rotor blade can be ground in a machine-based manner.

In an alternative embodiment, the grinding device furthermore comprises a drive unit for moving a rotor blade in relation to the belt grinding unit in the direction of the longitudinal axis of the rotor blade. In this embodiment, the rotor blade can be moved by means of another or a second drive unit in relation to the belt grinding unit. Hereby, the belt grinding unit can be arranged locally fixed. It is also possible to combine both embodiments with each other, so that both the belt grinding unit and the rotor blade can be moved against each other in the direction of the longitudinal axis of the rotor blade. It is only decisive that a relative movement between the rotor blade and the belt grinding unit in the direction of the longitudinal axis is possible so that the rotor blade can be ground in one continuous grinding iteration. Of course, also in the alternative embodiment, the rotor blade can be rotated around its longitudinal axis and thus the entire surface of the rotor blade can be ground in a machine-based manner.

Preferably, the grinding device comprises furthermore a dust belt unit with a circulating dust belt that is guided along at least one surface of the rotor blade in order to remove dust from the surface of the rotor blade. By means of the dust belt, the surface of the rotor blade can be cleaned from dust after the grinding, so that it is suitable for a direct new coating. An all but dust-free surface of the rotor blade is achieved by the use of the dust belt unit.

Preferably, the grinding device furthermore comprises at least one belt cleaning device. By means of the belt cleaning device, the grinding belt and/or the dust belt are continuously cleaned during the respective use of the belt. Thereby, in particular the life-time of the grinding belt exceeds many times the life-time of a grinding belt without a suction device or even that of a grinding belt where the dust is sucked off.

Preferably, the belt cleaning device cleans the grinding belt and/or the dust belt by means of a nozzle for bowing on of pressurized air and/or by means of a device for sucking off the grinding dust and/or a brush for brushing the grinding belt and/or the dust belt. By these three measures that can be used individually or in combination, a nearly complete cleaning of the grinding belt and the dust belt can be carried out, so that the life-time of both belts is only limited by mechanical wear. A clogging of the belts is thus effectively decreased, and the grinding dust is effectively removed without getting into the environment.

Preferably, the belt grinding unit comprises pressure members that press the grinding belt and/or the dust belt against a surface of a rotor blade, and which are supported by the drive unit. By means of the pressure members, the grinding pressure of the grinding belt or the cleaning pressure of the dust belt can be defined exactly and can be varied, and thus the grinding—and cleaning—conditions at the surface of the rotor blade can be defined exactly.

Preferably, the pressure members comprise in the direction of the lateral axis of a rotor blade movable element pressure bars or pressure rollers at the drive unit. Element pressure bars or pressure rollers can adapt themselves to the curved surface of the rotor blade. Thus, this results in a homogeneous contact pressure for the grinding belt or the dust belt. By the movement of the pressure members, it is ensured that every surface is ground or cleaned for a sufficiently long time with the respective desired contact pressure.

Preferably, the pressure members can be moved pneumatically against the surface of a rotor blade in order to define the grinding pressure of the grinding belt and/or the cleaning pressure of the dust belt to the surface. Due to the pneumatic control, the grinding pressure of the grinding belt can be exactly defined by the used air pressure. Thereby, the pressure members adapt themselves automatically to the curved surface of the rotor blade without a complex control being necessary therefore. The single elements of the element pressure bar or the pressure rollers are each charged with the same air pressure so that their pressure onto the surface is always constant even with changing geometries of the surface of the rotor blade. Of course, the same principle can also be realized by a hydraulic control.

Preferably, the pressure members comprise a suction hood in order to suck the grinding dust through the grinding belt and/or the dust belt and through the pressure member. Hereby, the grinding dust is in part already sucked off where it is generated or picked up, so that a clogging of the grinding belt and of the dust belt is avoided.

Preferably, the dust belt unit is attached to the drive unit and thus can also be moved in the longitudinal direction along the rotor blade.

Preferably, the drive unit comprises a wagon that is movable in the longitudinal direction, by which, perpendicular thereto, the belt grinding unit and/or the dust belt unit is movably supported. The drive unit serves for guiding the belt grinding unit and/or the dust belt unit during the respective processing along the rotor blade and towards the rotor blade and away from it.

Preferably, the grinding device further comprises a control unit that controls numerically at least the movements of the drive unit and/or the movements of the pressure members in the direction of a rotor blade. The movement of the drive unit and/or the movements of the pressure members in the direction of the rotor blade are preferably controlled numerically (NC) in order to grind the entire surface of the rotor blade under constant contact pressure and to the desired degree. The control unit causes the drive unit to follow the contours of the respective rotor blade.

Preferably, the grinding device further comprises a belt tensioner that maintains the grinding belt under a tension which is necessary for grinding.

Preferably, the grinding belt is a perforated grinding belt that is substantially provided with perforation openings over its entire surface. By the use of a perforated grinding belt which, in contrast to common grinding belts, comprises many small perforation openings that are arranged close to each other, the grinding dust has to travels only a very short distance for being sucked through the grinding belt to the back side. Accordingly, the risk of clogging of the grinding belt is reduced by the use of perforated grinding belts.

In a preferred embodiment, the grinding device further comprises a coating unit for the automated coating of the surface of a rotor blade that is attached to the drive unit. By means of the coating unit, the rotor blade can be newly coated or lacquered, respectively, after the grinding, with the same device. This has the advantage that the rotor blade can remain in the system and does not have to be moved to a lacquering system. Furthermore, an automated coating is significantly more homogeneous than a manual application and without risks for a lacquerer.

Preferably, the coating unit comprises at least one automatically movable coating roller and/or at least one automatically movable spraying unit and/or at least one radiant heater. The coating of the rotor blade can be carried out by roller application or by spraying, whereby the respective coating type depends on the material used for coating. After the coating, or also already in parallel thereto, the newly coated surface can be dried in an accelerated manner by means of a radiant heater. By doing so, the overall processing time of the rotor blade is reduced.

In a further embodiment of the invention, the invention relates to a ship for the processing of rotor blades of wind energy systems with a grinding device as it has been described above. Such a ship with a grinding device for machine-based grinding of rotor blades for wind energy systems could be used, in particular, for the revision of rotor blades of offshore-wind-energy-systems. The possibility of grinding and newly coating the rotor blades directly on the sea reduces the transport times of the rotor blades during the revision, and the wind energy system is again operable within the shortest time.

4. SHORT DESCRIPTION OF THE FIGURES

Figure 2:
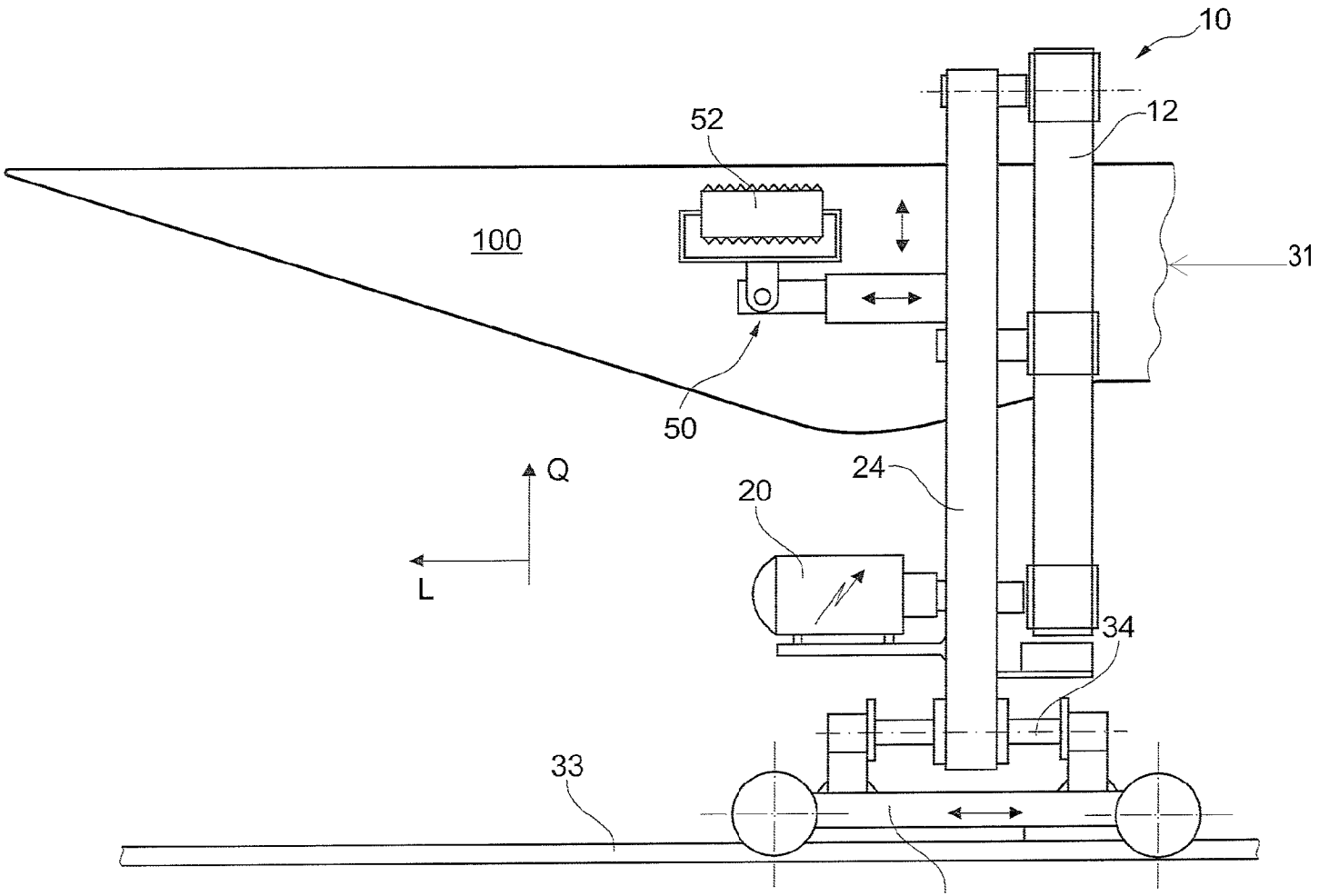
Figure 3:
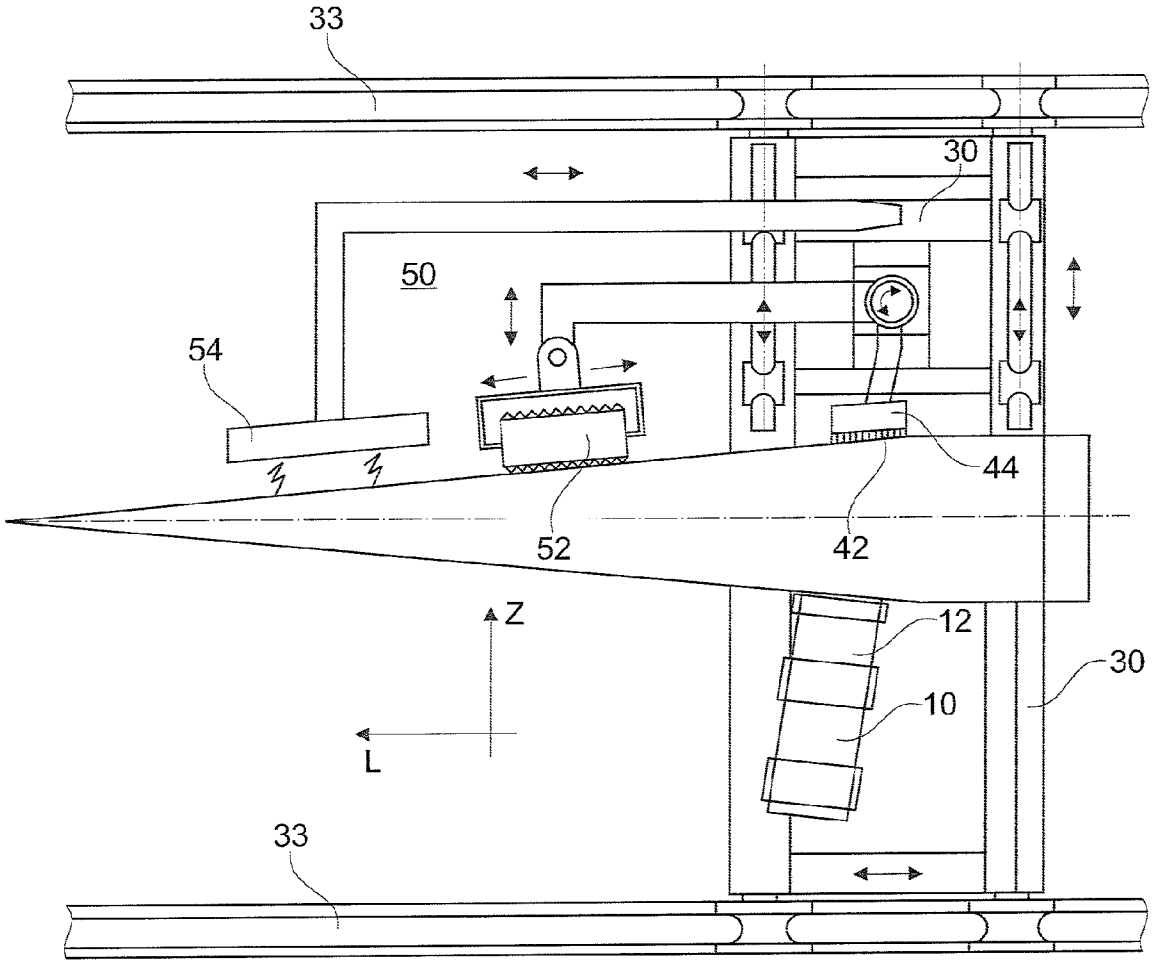
Figure 4:
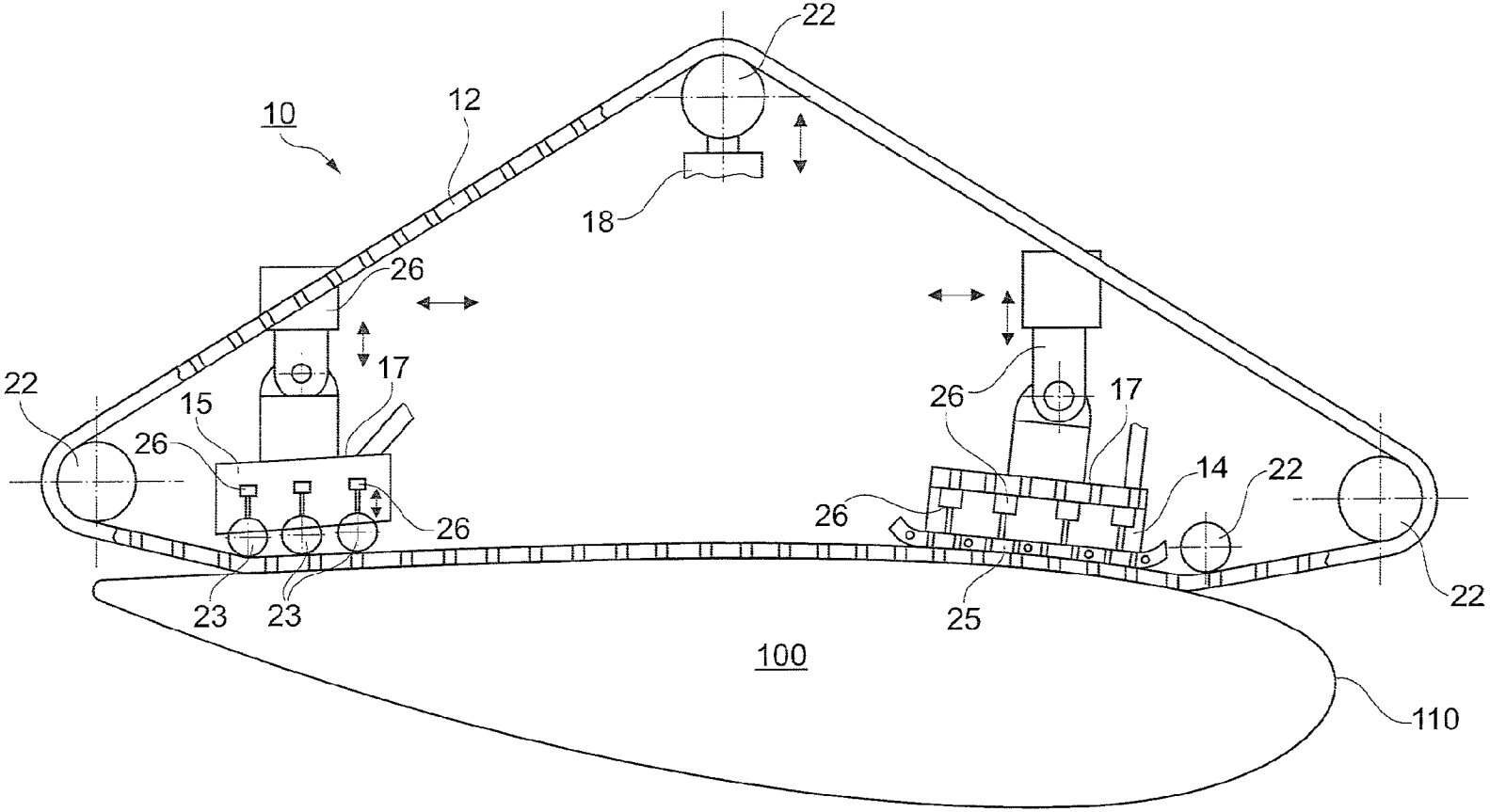
Figure 5:
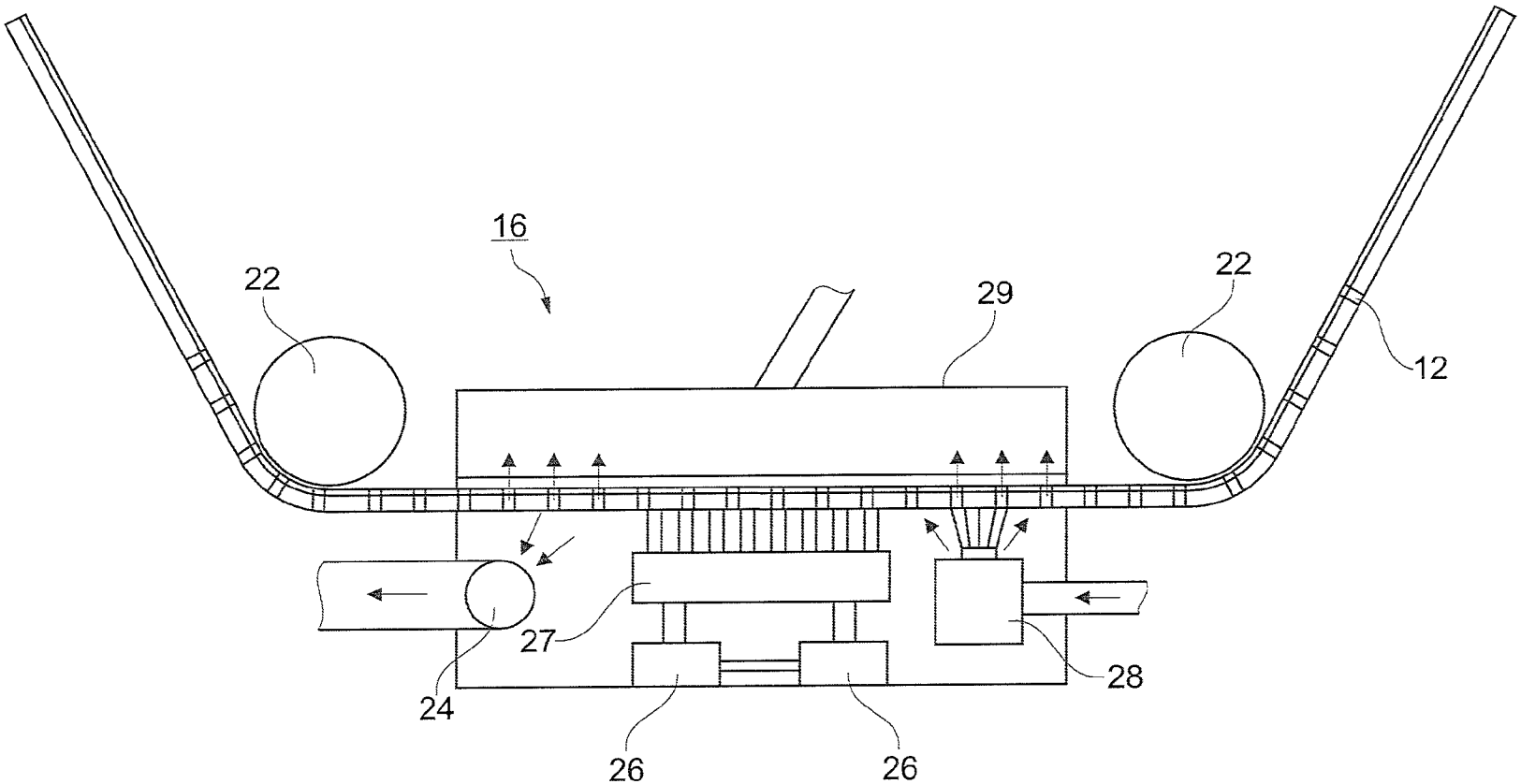

In the following, preferred embodiments of the invention are described with reference to the figures, in which shows:

FIG. 1: a cross-sectional view through a first embodiment of a grinding device according to the invention for machine-based grinding of rotor blades for wind energy systems;

FIG. 2: a side-view of the grinding device according to FIG. 1;

FIG. 3: a view from above of a further embodiment of a grinding device for machine-based grinding of rotor blades for wind energy systems;

FIG. 4: a cross-sectional view of a belt grinding unit in engagement with a rotor blade; and FIG. 5: a cross-sectional view of a belt cleaning device during the cleaning of a grinding belt.

5. DESCRIPTION OF PREFERRED EMBODIMENTS

In the following, preferred embodiments of the invention are described with reference to the figures. Individual features of the embodiments described herein may be combined with other embodiments of the invention.

FIG. 1 shows a side-view of a grinding device 1 for the machine-based grinding of rotor blades 100. In FIG. 1, a belt grinding unit 10 is arranged at the right-hand side of the rotor blade 100, the belt grinding unit being able to grind with a circulating grinding belt 12 a surface 110 of a rotor blade 100 of a wind energy system. As shown, the circulating grinding belt 12 is guided by means of guide rollers 22 that are attached to a base body 21 of the belt grinding unit 10. The drive of the grinding belt 12 is carried out via a controllable electric motor 20 that determines the grinding speed. In order to provide always the necessary tension to the grinding belt, the belt grinding unit 10 is equipped with a belt tensioner 18 that acts on the belt 12 via a guide roller 22.

The belt grinding unit 10 comprises pressure members 14, 15 that can be moved in lateral direction at the base body 21 upwards and downwards in a numerically controlled manner and which press pneumatically in the direction Z against the back side of the grinding belt 12. The pressure members 14, 15 serve for pressing the grinding belt 12 with the necessary grinding pressure onto the surface 110 of the rotor blade 100 and to specifically apply this grinding pressure to any desired location on the surface 110. Thus, by the movability of the pressure members 14, 15 at the base body 21, every surface area of the surface 110 can be ground with the desired pressure and for the desired period of time.

The pressure members 14, 15 may be moved pneumatically by means of one or more pneumatic pistons 26 in the direction Z against the surface of the rotor blade in order to apply the necessary grinding pressure. Then, the required grinding pressure can be very easily adjusted via the pressure in the respective pneumatic pistons 26.This has the advantage that also with varying geometries of the surface 110, always the same defined grinding pressure can be adjusted for grinding. This happens in a purely mechanical manner without a necessity of complex control devices therefore.

The pressure members may be designed as movable element pressure bars 14 or as pressure rollers 15, as shown in detail in FIG. 4. As an example, in FIG. 4 at the left-hand side, a pressure member 15 with three pressure rollers 23 is shown which press against the back side of the grinding belt 12. Both the pressure member 15 as a whole and the single pressure rollers 23 are equipped with corresponding pneumatic pistons 26 that are individually controlled. Thus, a point-specific and individually adjustable grinding of the surface no is possible. The pressure rollers 23 are surrounded by a suction hood 17 to which a negative pressure is applied in order to suck the grinding dust through the grinding belt 12. As shown in FIG. 1 and FIG. 4, the pressure members 14, 15 may further be provided with guide rollers 22 which ensure a low-friction transition of the grinding belt 12 to the pressure member 14, 15.

On the right hand side of FIG. 4 a pressure member 14 in form of an element pressure bar 14 is shown. The element pressure bar 14 as a whole is also pressed by a pneumatic piston 26 against the back side of the grinding belt 12, wherein the elements 25 of the element pressure bar 14 are also pressed against the grinding belt 12 by own pneumatic cylinders 26 that can be individually controlled. Also here an individually controllable and specific grinding of the surface 110 of the rotor blade 100 is possible. The element pressure bar 14 is provided with a suction device (not shown) that effects on a suction hood 16. For an effective suctioning the element pressure bar 14 is provided with openings that allow a suctioning of grinding dust through the grinding belt 12.

The grinding belt 12 is preferably a perforated grinding belt that is provided with comparatively small perforation openings that comprise a diameter of preferably 1 mm to 4 mm and a distance of the perforation openings to each other of preferably 10 mm to 20 mm. It is possible by this perforation to remove the grinding dust quasi over its entire surface from the grinding surface and to suck it through the grinding belt 12. According to this already by this kind of suctioning a clogging of the grinding belt is reduced. The grinding belt can be commonly made of a carrier tissue with abrasive particles that are coated thereon and can comprise a width of preferably 100 mm-300 mm.

But since the coatings to be ground during the manufacturing and maintenance of rotor blades 100, namely gel coat, spackle, filler and cover layers are designed more viscoplastic, it is not possible to avoid a clogging of the grinding belt 12 by a mere suction device. Thus, the belt grinding unit 10 is furthermore equipped with a belt cleaning device 16 for the grinding belt 12. The belt cleaning device 16 comprises preferably as shown in FIG. 5 a nozzle 28 for blowing on and off respectively of pressurized air onto the grinding surface of the grinding belt 12. By doing so, smoothly adhering dust particles can be removed from the grinding surface of the grinding belt 12 that can be sucked off then by a suction unit (not shown) that is connected to a suction hood 29. Furthermore, the belt cleaning device 16 comprises a brush 27 that is pressed by means of pressure pistons 26 against the grinding surface of the grinding belt 12. The brush 27 also removes tightly adhering, ductile grinding dust that could not be removed by the blowing with the nozzle 28. The removed grinding dust is then sucked off by means of the suction hood 29 and an additional suction device 24 that is directed to the grinding side of the grinding belt 12.

It is possible with the belt cleaning device 16 to clean the grinding belt 12 quasi completely from adhering grinding dust of viscoplastic coatings of the rotor blade 100. Thereby the fact is used that always only a part of the grinding belt 12 is engaged with the surface 110 of the rotor blade 100 and a large part of the grinding belt 10 can be accessed easily, in particular for the belt cleaning.

As shown in the FIGS. 1, 2 and 3 the belt grinding unit 10 can be moved by a drive unit 30 along the rotor blade 100. This is carried out preferably by an electrically driven drive wagon 32 that is guided numerically controlled (NC) on tracks 33 along the longitudinal axis L of the rotor blade. Alternatively, a drive unit 31 can be used to move the rotor blade past the belt grinding unit 10 in the direction of the longitudinal axis L of the rotor blade. On the drive wagon 32 also with an electrically driven wagon 34 the belt grinding unit 10 all in all can move numerically controlled (NC) in direction Z towards the rotor blade 100 or away from the rotor blade 100.

Alternatively to this shown embodiment the belt grinding unit 10 can be also arranged at the grinding device 1 rigidly fixed and the rotor blade 100 might be supported moveably and driven along the belt grinding unit 10 by another drive unit in a numerically controlled manner (NC) in direction L. Then, the rotor blade 100 is guided along the belt grinding unit 10 for grinding. Also here, the belt grinding unit 10 can be moved together with an electrically driven wagon numerically controlled (NC) in direction Z towards the rotor blade 100 or away from the rotor blade 100. Also a combination of both drive alternatives is possible namely both a movement of the belt grinding unit 10 and of the rotor blade 100 in the direction of the longitudinal axis of the rotor blade by two independent drive units.

By the individual movability of the pressure members 14, 15 within the belt grinding unit 10 in lateral direction Q and direction Z together with the movability of the belt grinding unit 10 all in all in longitudinal direction L it is possible to grind locally at each position of the surface 110 of the rotor blade 100 as desired.

As shown in FIG. 1, the grinding belt 12 is actually engaged with the upper shell of the rotor blade 100. In order to grind also the leading edge and the bottom shell of the rotor blade respectively it is furthermore possible to rotate the rotor blade 100 around the longitudinal axis L and to fix the rotor blade in the desired position 100 for processing. But it is also possible to provide the grinding devices with multiple belt grinding units 10 so that it is possible to process the rotor blade 100 at both sides or at all sides in parallel. Therefore it is furthermore advantageous that oppositely arranged belt grinding units 10 apply each a counter pressure on the rotor blade 100 so that a bending of the rotor blade 100 during the grinding process is avoided as far as possible.

In a similar way, like the belt grinding unit 10 is in FIG. 1 on the left hand side a dust belt unit 40 with a circulating dust belt 42 attached to the grinding device 1. A base body 41 carries guide rollers 49 that ensure the circulation of a dust belt 42. The dust belt 42 is guided along the surface 110 of a rotor blade 100 in order to pick up the grinding dust that is generated there and in order to remove dust nearly completely from the surface 110. By doing so, with a dust belt unit 40 an automatic wiping and dedusting of the rotor blade respectively can be carried out. The dust belt unit 40 comprises a belt tensioner 48 that tensions the dust belt 40 that consists preferably of a fleece material.

Preferably, the dust belt unit comprises pneumatically controlled pressure members 44 that press the dust belt 42 against the surface 110. The pressure members 44 can be moved at the base body 41 in lateral direction Q upwards and downwards in order to selectively press the dust belt 42 to the desired position of the surface 110 of the rotor blade 100. The pressure elements 44 are similar in their construction like the pressure elements 14, 15 for the grinding belt 12 as shown in FIG. 4.

The pressure members 44 furthermore comprise a suction hood 47 in order to suck the dust from the dust belt 42 that was picked up by the dust belt 42. In addition the dust belt unit 40 is also provided with a belt cleaning device 46 that corresponds in general with the belt cleaning device 16 of the grinding belt 12 as it is shown in FIG. 5. By the belt cleaning device 46 the dust belt 42 is continuously cleaned from picked up grinding dust so that a clogging of the dust belt 42 is avoided.

The dust belt unit 40 as a whole is similar to the belt grinding unit 10 and is supported on the moveable drive wagon 32 by means of a further electrically driven wagon 35 that is moveable and numerically controlled (NC) in Z-direction, so that the entire surface 110 of the rotor blade 100 can be cleaned.

As shown in FIG. 2, the grinding device 1 furthermore comprises a coating unit 50 that serves for the automatic coating of the surface 110 of a rotor blade 100. The coating unit 50 may comprise at least one automatically moveable coating roller 52 and/or at least one automatically moveable spray unit and /or at least one radiant heater 54 (cf. FIG. 3). By means of such a coating unit 50 the ground and cleaned rotor blade 100 can be coated in the next layer to be applied of the layer system. Depending on the viscosity of the coating to be applied a spray unit (not shown) or an automatically moveable coating roller 52 is used.

In order to dry the newly applied layer faster and to process the rotor blade 100 faster on, the grinding device 1 can be equipped also with at least one electric radiant heater 54 that can be also be positioned on every point of the surface 110 of the rotor blade 100.

Rotor blades 100 for wind energy systems have to be maintained in regular intervals and have to be also recoated when this is necessary because of damage or load. To this end, the surface 110 of the rotor blade 100 is ground and then is provided with a new coating. Since many of the wind energy systems are erected in the sea (so called offshore-wind-energy-systems) it is foreseen to provide a ship for the processing of rotor blades of wind energy systems on which an automatic grinding device 1 as described above is installed. Herewith, maintenance of the rotor blades 100 is possible on the site and the transportation ways are reduced. Since the complete automation of the grinding, cleaning and recoating, these processes can be also carried out on a ship that moves continuously.

LIST OF REFERENCE NUMBERS

1 Grinding device
10 Belt grinding unit
13 Grinding belt
14 Pressure member as element pressure bars
15 Pressure member with pressure rollers
16 Belt cleaning device
17 Suction hood
18 Belt tensioner
20 Drive
21 Base body
22 Guide rollers
23 Pressure rollers
24 Suction device
25 Elements of the element pressure bars
26 Pressure piston
27 Brush
28 Nozzle
29 Suction hood
30 Drive unit

32 Drive wagon
33 Tracks
34 Wagon
35 Wagon
40 Dust belt unit
41 Base body
42 Dust belt
44 Pressure members
46 Belt cleaning device
47 Suction hood
48 Belt tensioner
49 Guide rollers
50 Coating units
52 Coating roller
54 Radiant heater
100 Rotor blade
110 Surface of the rotor blade

The invention claimed is:

1. Grinding device (1) for the machine-based automated grinding of a surface (110) of a rotor blade (100), the rotor blade having a longitudinal axis direction (L) and a transverse axis direction (Q), the grinding device comprising:

a belt grinding unit (10) having a continuous grinding belt (12) the continuous grinding belt (12) having a belt velocity imparted to it by a motor (20), the continuous grinding belt (12) having a portion that engages the surface (110) of the rotor blade (100), the portion of the grinding belt (12) that engages the surface (110) of the rotor blade (100) having a belt velocity in a direction that is transverse to the longitudinal axis direction (L) of the rotor blade (100); and at least one belt cleaning device (16, 46) operating to clean a portion of the grinding belt (12) that is distal from the portion of the grinding belt (12) that is in contact with the surface (110) of the rotor blade (100).

2. Grinding device according to claim 1, further comprising a drive unit (30) for moving the belt grinding unit (10) in the direction (L) of the longitudinal axis of the rotor blade (100).

3. Grinding device according to claim 1, further comprising a drive unit (31) for moving the rotor blade (100) relative to the belt grinding unit (10) in direction (L) of the longitudinal axis of the rotor blade (100).

4. Grinding device according to claim 2, further comprising a dust belt unit (40) with a circulating dust belt (42) that is guided along the surface (110) of the rotor blade (100), in order to remove dust from the surface (110) of the rotor blade (100).

5. Grinding device according to claim 4, wherein the belt cleaning device (16, 46) cleans the grinding belt (12) and/or the dust belt (42) by means of:

a) a nozzle (28) for blowing on of pressurized air; and/or b) a device (24) for suctioning grinding dust; and/or c) a brush (27) for brushing the grinding belt (12) and/or the dust belt (40).

6. Grinding device according to claim 4, wherein the belt grinding unit (10) comprises pressure members (14, 15, 44) that press the grinding belt (12) and/or the dust belt (42) against a surface (110) of a rotor blade (100) and that are supported at the drive unit (30).

7. Grinding device according to claim 6, wherein the pressure members (14, 15, 44) comprise in direction (Q) of the lateral axis of a rotor blade (100) moveable element pressure bars (14) or pressure rollers (15) at the drive unit (30) that can be moved preferably pneumatically to the surface (110) of a rotor blade (100) in order to define the grinding pressure of the grinding belt (12) and/or the cleaning pressure of the dust belt (42) to the surface (110).

8. Grinding device according to claim 6, wherein the pressure elements (14, 15, 44) comprise a suction hood (17, 47), in order to suck grinding dust through the grinding belt (12) and/or the dust belt (42) and through the pressure member (14, 15, 44).

9. Grinding device according to claim 4, wherein the dust belt unit (40) is mounted at the drive unit (30).

10. Grinding device according to claim 2, wherein the drive unit (30) comprises a drive wagon (32) that can be moved in longitudinal direction (L) on which perpendicular thereto (Z) the belt grinding unit (10) and/or the dust belt unit (40) are moveably supported.

11. Grinding device according to claim 2, further comprising a control unit that controls numerically at least the movements of the drive unit (30) and/or the movements of pressure members (14, 15) in direction (Z) of the rotor blade (100).

12. Grinding device according to claim 1, further comprising a belt tensioner (18) that provides the grinding belt (12) with the tension that is necessary for grinding.

13. Grinding device according to claim 1, wherein the grinding belt (12) is a perforated grinding belt, which is provided essentially over its entire surface with perforation openings.

14. Grinding device (1) for the machine-based automated grinding of a rotor blade (100) for wind energy system, the rotor blade (100) having a longitudinal axis direction (L), the grinding device comprising a belt grinding unit having a continuous grinding belt (12), the continuous grinding belt (12) having a portion that engages a surface (110) of the rotor blade (100), the portion of the grinding belt (12) that engages the surface (110) of the rotor blade (100) having a belt velocity in a direction that is transverse to the longitudinal axis direction (L) of the rotor blade (100); the grinding device further comprising a coating unit (50) for the automated coating of the surface (110) of the rotor blade that is mounted to the grinding unit (10).

15. Grinding device according to claim 7, wherein the pressure elements (14, 15, 44) comprise a suction hood (17, 47), in order to suck grinding dust through the grinding belt (12) and/or the dust belt (42) and through the pressure member (14, 15, 44).

16. Grinding device according to claim 9, further comprising a control unit that controls numerically at least the movements of the drive unit (30) and/or the movements of pressure members (14, 15) in direction (Z) of the rotor blade (100).

17. Grinding device (1) according to claim 14, wherein the coating unit (50) comprises:

a) at least one automatically moveable coating roller (52); and/or b) at least one automatically moveable spray unit; and/or c) at least one radiant heater (54).

* * * * *